United States Patent [19]

Andrews, Jr.

[11] 4,352,263

[45] Oct. 5, 1982

[54] METHOD OF PACKAGING FOWL WITHIN STRETCH BAGS

[75] Inventor: H. David Andrews, Jr., College Park, Ga.

[73] Assignee: Star Packaging Corporation, College Park, Ga.

[21] Appl. No.: 154,678

[22] Filed: May 30, 1980

Related U.S. Application Data

[63] Continuation-in-part of Ser. No. 60,939, Jul. 26, 1979, Pat. No. 4,219,989.

[51] Int. Cl.[3] ..... B65B 5/04; B65B 39/10

[52] U.S. Cl. ..... 53/436; 53/459; 53/258

[58] Field of Search ..... 53/258, 260, 261, 436, 53/439, 459, 469, 556, 571, 572, 573

[56] References Cited

U.S. PATENT DOCUMENTS

| | | | |
|---|---|---|---|
| 2,946,166 | 7/1960 | Baxter | 53/258 X |
| 3,330,093 | 7/1967 | Schorer | 53/572 |
| 3,490,195 | 1/1970 | Abramson | 53/572 X |
| 3,877,562 | 4/1975 | Shaw | 53/572 X |
| 3,971,191 | 7/1976 | Hoyland | 53/258 X |
| 4,028,775 | 6/1977 | Tysver | 53/258 X |
| 4,033,088 | 7/1977 | Markert | 53/572 X |
| 4,047,362 | 9/1977 | Lister et al. | 53/572 |
| 4,147,012 | 4/1979 | Van Mil | 53/469 X |
| 4,155,212 | 5/1979 | Marchese | 53/258 |
| 4,157,003 | 6/1979 | Kamphaus | 53/258 |
| 4,183,194 | 1/1980 | Lucke | 53/571 |
| 4,203,269 | 5/1980 | Petersen | 53/258 X |

FOREIGN PATENT DOCUMENTS

| | | | |
|---|---|---|---|
| 1319048 | 5/1973 | United Kingdom | 53/258 |

*Primary Examiner*—R. L. Spruill
*Assistant Examiner*—Charles L. Willis
*Attorney, Agent, or Firm*—David H. Semmes

[57] ABSTRACT

Stretch bagging, particularly a method for stuffing a chicken carcass into a stretch plastic bag. The method is characterized by its alternate application of a central pushing force and a chicken leg pushing force, so as to hock or compress the chicken within the stretch bag. The hocking of the chicken within the bag eliminates the time-consuming and expensive necessity for clipping the chicken legs together prior to packaging and, also, presents a more uniform and pleasing appearance of the packaged carcass.

1 Claim, 19 Drawing Figures

METHOD OF PACKAGING FOWL WITHIN STRETCH BAGS

CROSS REFERENCES TO RELATED APPLICATIONS

A continuation-in-part of Applicant's BAGGING APPARATUS (Ser. No. 060,939), filed July 26, 1979, issued as U.S. Pat. No. 4,219,989. The parent application is directed to an apparatus for stretching open an open ended bag, so that a chicken carcass may be stuffed therein.

The present application is directed to a combined method of stretching open an open ended bag, mechanically stuffing the chicken carcass within the bag, and "hocking" or compressing the chicken within the bag.

BACKGROUND OF THE INVENTION

Field of the Invention

Stretch bagging, particularly a method for simultaneously stretching open conventional plastic bags and stuffing a chicken carcass or the like into the opened bag. The method is characterized by its ability to compress or hock the chicken carcass within the bag, such that the legs conform to the chicken body and present a more pleasing appearance within the plastic bag.

SUMMARY OF THE INVENTION

According to the present invention, a plurality of open ended stretch bags are mounted upon a bag elevator which is supported within the line of axial advance of the chicken carcass. The fowl carcass is inverted such that the breast is topmost and the legs protrude rearwardly above the tail. The carcass may be axially aligned from above while centrally pushing the carcass in a longitudinal direction towards the bag elevator. The topmost stretch bag is opened by pressurized air, then stretched transversely by a pair of bag opening horns. Simultaneously, the central pushing of the carcass is withdrawn while engaging and pushing both legs of the carcass, so as to longitudinally stuff the carcass into the open ended bag. Then, central pushing is reapplied to the carcass, so as to retain the carcass within the bag as the pushing of both legs and the stretching of the bag is withdrawn. The packaged fowl may then be removed for tying, heat shrinking, freezing or the like. The cycle may be then repeated such that 12–15 birds per minute may be packaged by two operators, one operator on the machine and another operator removing the packaged bird for tying.

The method is characterized particularly by the ability to hock or compress the fowl carcass within the bag, such that the leg joints are "broken" so as to present a more compact and pleasant appearing package. The hocking of the bird within the package eliminates the expensive and time-consuming conventional necessity for clipping of the legs together prior to compressing within the bag.

DESCRIPTION OF THE DRAWINGS

FIG. 1-B is a schematic view, showing engaging and pushing both legs of the carcass, so as to longitudinally advance the carcass into an open-ended bag;

FIG. 1-C is a schematic view, showing engaging and pushing both legs of the carcass, while interposing a restraining force at the forward end of the carcass, such that the carcass is "hocked" or compressed within the bag;

FIG. 1-D is a schematic view, showing centrally pushing the carcass so as to retain the carcass within the bag, while withdrawing pushing of both legs and stretching of the bag; and FIG. 1-E is a schematic view showing the packaged carcass prior to removal and tying.

FIG. 4 is a similar top plan showing the completed package resting against the restraining plate and prior to removal for cutting, tying, freezing the like;

DESCRIPTION OF THE PREFERRED EMBODIMENTS

Figure 1B:
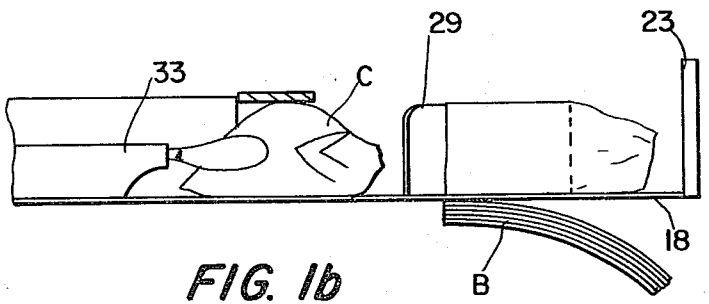
FIG. 1-A is a schematic view, showing axially advancing by centrally pushing the carcass in a longitudinal direction.
Figure 1A:
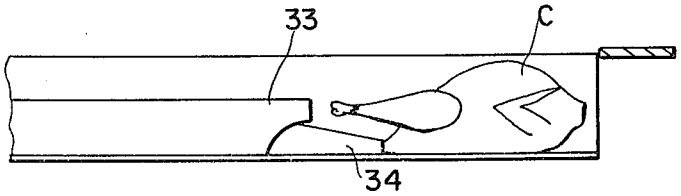
Figure 1E:
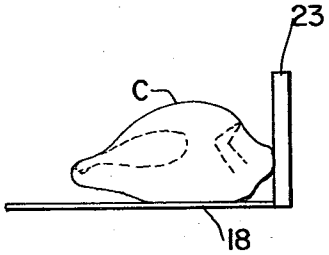
Figure 1D:
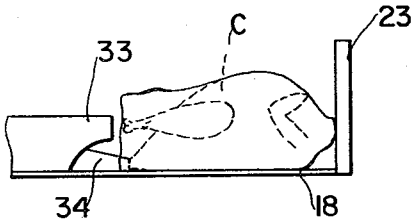
Figure 1C:
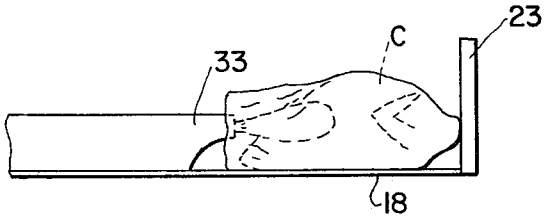

The suggested device is similar to Applicant's BAGGING APPARATUS (Ser. No. 60,939, now U.S. Pat. No. 4,219,989), using the same parts in many instances but with many new features and actions.

This machine allows an operator to place the bird carcass to be packaged on its back in front of the main hocking pusher assembly 33 and pre-hocking center pusher 34, which includes pre-hocking pushing cylinder 35, quick disconnect joint 36 and release pin 37. The bird is placed between product guides 32 under the leg and keel control plate 28 and into the funnel shaped portion of the stretch horns 29 and 30. Keel control plate 28 may be fixed to horizontal plate 27, in turn, supported upon upright members 25, 26.

The machine and fowl carcass are now at starting position of a normal automatic cycle. The machine is provided with a main pusher cylinder 51 of appropriate bore and stroke and including main pusher cylinder half quick disconnect 38, mounting base 39, front upright 40, support riser 41, pusher cylinder rod support base 42, pusher cylinder rod bushing mounting block 43, pusher cylinder rod bushing 44, rod mounting bar 45, cover mounting bar 46, guide rod bushing 47, guide rod 48, bagging side guide rod support bar 49, Operator Side guide rod support bar 50, limit valve adjustment base 52, limit valve adjustable base piece 53, push cylinder rear mounting lower half 54, push cylinder rear mounts upper half 55 and assembly cover 56. The foregoing assembly supports main pusher cylinder 51 and the required limit valves to give signals to the control logic system at the proper place in the forward or backward stroke of the main pusher cylinder 51.

The entire assembly is mounted upon control cabinet top 65 designed to locate and line up the pusher assembly on the center line of the front to back axis of the machine.

Attached to the pusher cylinder quick change tooling plate 38 by the pusher half of the quick change tooling plate 36 is the main pusher assembly consisting of a main hocking product pusher 33, pre-hocking center pusher 34, pre-hocking pusher cylinder 35, pusher half-quick disconnect joint 36 and release end 37.

Figure 6:
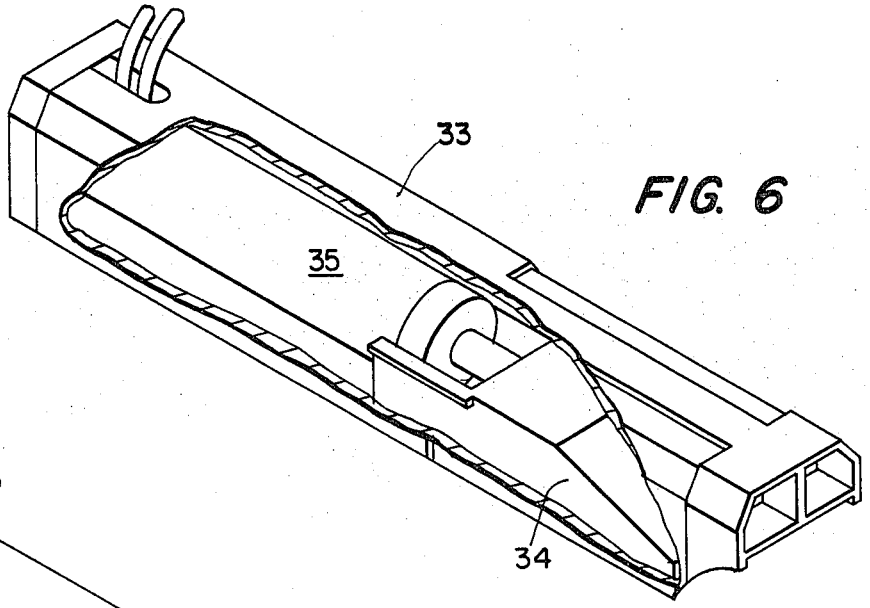
FIG. 6 is a fragmentary perspective view of the main pusher assembly with the center pusher assembly shown in phantom and axially withdrawn therein.
Figure 7:
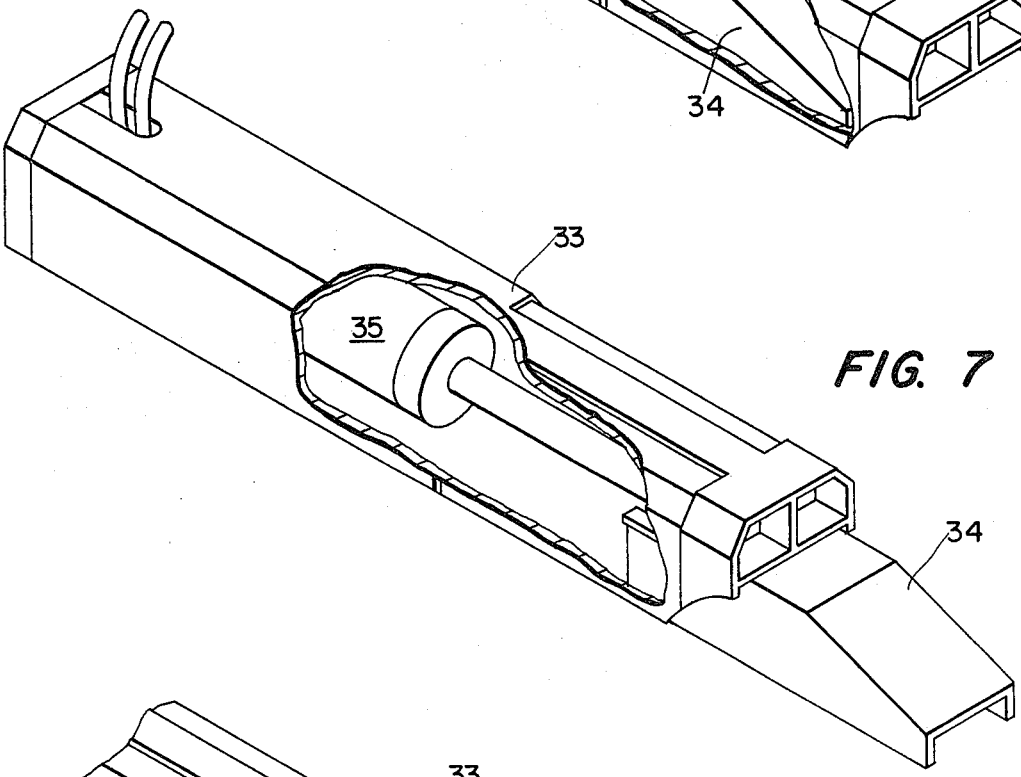
FIG. 7 is a fragmentary perspective view of the main pusher assembly with the center shown axially extended therefrom.
Figure 8:
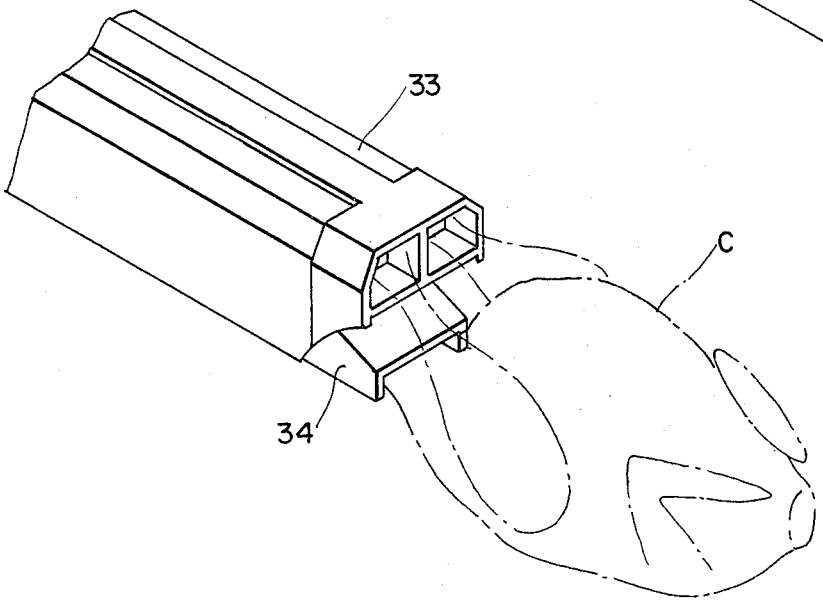
FIG. 8 is a perspective view of the main pusher apparatus having dual concavities for engaging the chicken leg ends during pushing and the central pusher for engaging the Parson's nose, while the chicken legs extend over the inclined surface.

As illustrated in FIGS. 6–8.

Main hocking pusher 33 is the main pusher body which has been machined to include two leg socket cavities which receive the two leg joints to control the forward movement of the bird into the bag and to push the legs forward (hock the bird) after the bagged bird comes up against the hocking pad 24 located in the hocking control plate 23, all of which is mounted upon the hocking tray table 18.

The main pusher 33 is further machined to receive the pre-hocking center pusher 34 and its control cylinder 35. This unit extends forward at the proper time in the control cycle to push the bird in between stretch horns 29 and 30 and under leg and keel control plate 28 to bring the legs into correct alignment with the leg socket cavities machined into the face of the main pusher 33. At the proper point in the pushing stroke, a limit valve actuated by push cylinder guide rod 48 signals the center pusher 34 to retract within main pusher 33, thereby transferring the pushing action from the center of pre-hocking pusher 34 to the main pusher 33.

The center pusher 33 retracts within the main pusher deep enough to permit the lower portion of the bird, which the center pusher 34 was pushing against, to fit into a cleared space machined into the main pusher 33, so as to allow the main pusher to "over hock" or "set the hock".

Figure 11:
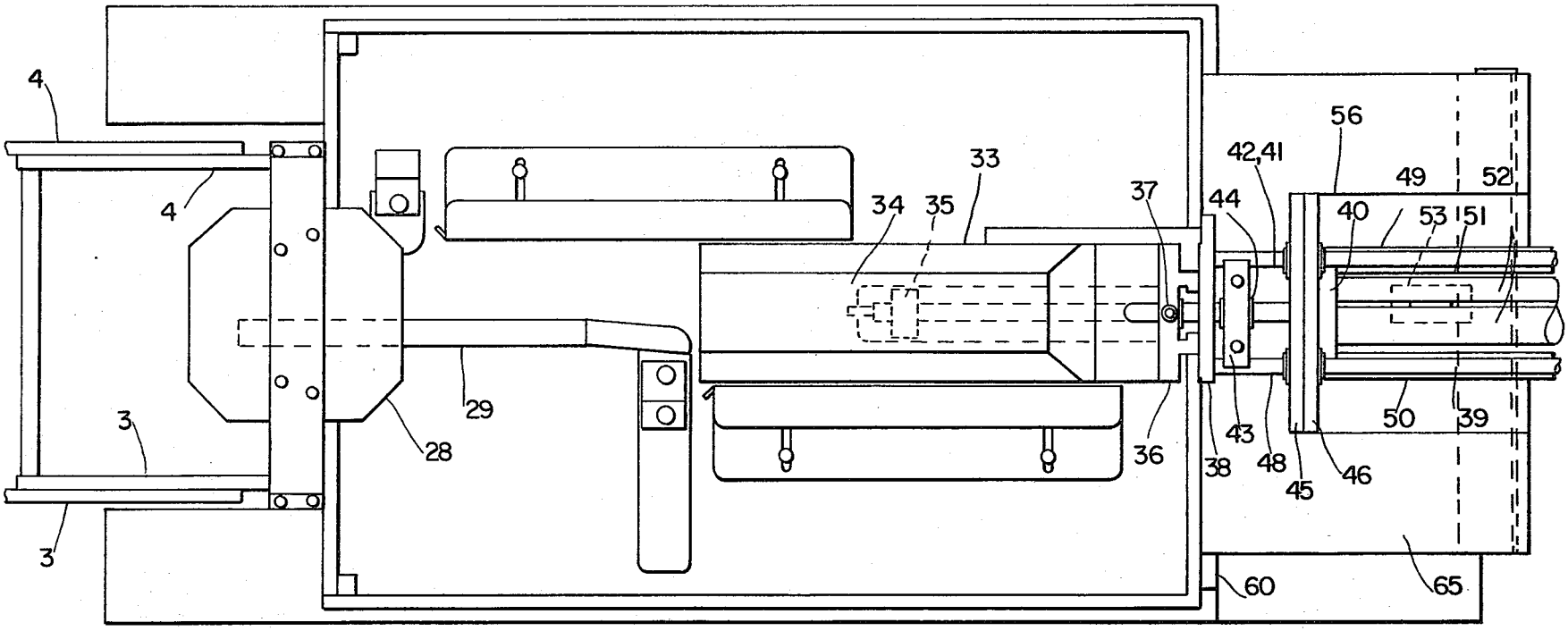
FIG. 11 is a top plan, showing the supporting table in retracted position away from the hocking plate.
Figure 12:
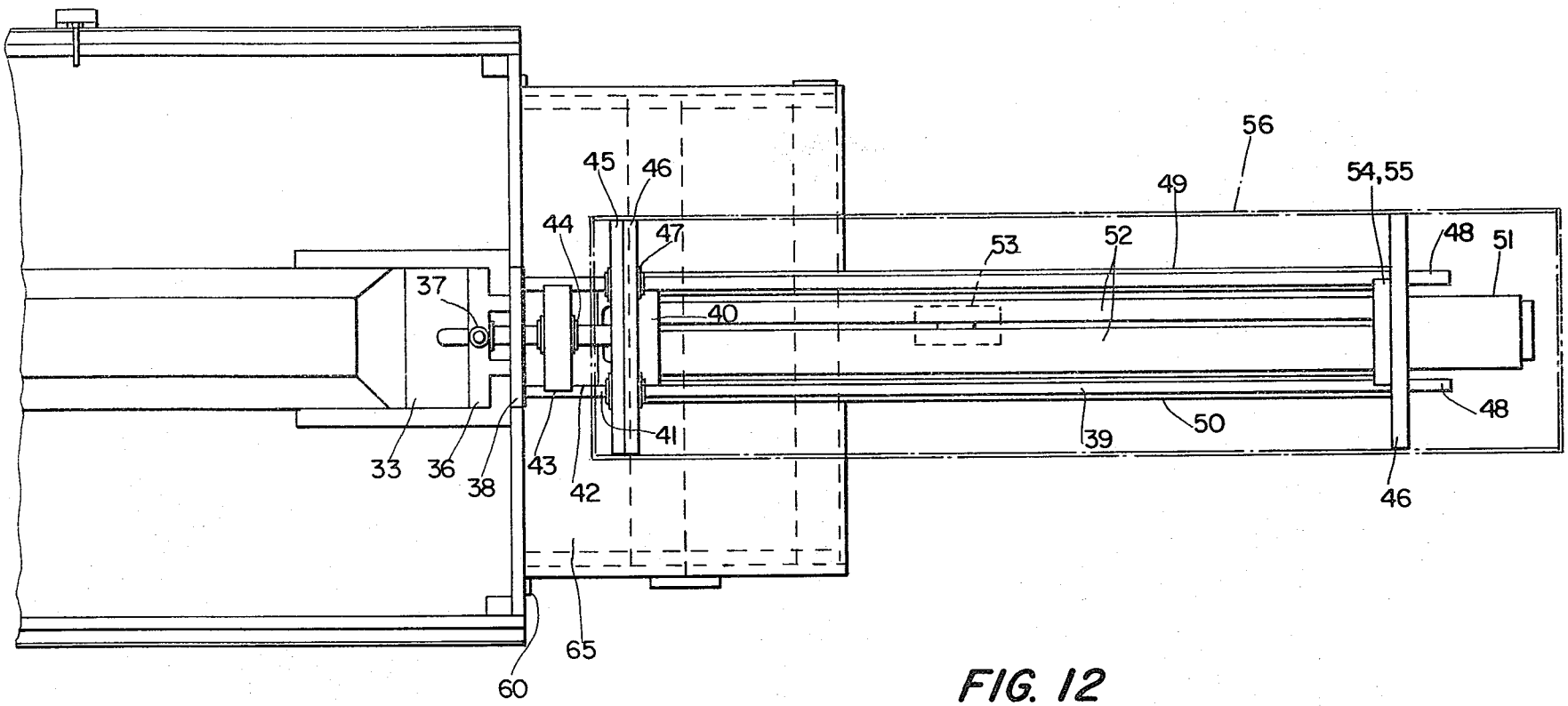
FIG. 12 is a fragmentary top plan, showing the push cylinder assembly in the advanced position towards the hocking plate.

As illustrated in FIG. 11 the center pusher cylinder 35 is attached at its rod end to the center pusher 34 and at its cap or pivot end by a pin 37 fitted in the pusher quick tooling change half 36.

As illustrated in FIG. 7 the center pusher 34 and the center pusher cylinder 35 are retained in the main pusher 33 by a T-slot machined in the main pusher body 33 and a pin 37. The center pusher 34 has a cross-section that conforms to the cross-section machined into the main pusher body 33. To release the center pusher 34 and center pusher cylinder 35 from the main pusher body 33 for cleaning or maintenance, pull pin 37, slide the center pusher 34 and center pusher cylinder 35 forward until the tang of pusher cylinder 35 comes clear of quick disconnect joint 36 and the ribs of pusher 34 and lines up with the removal slots in 33.

Figure 2:
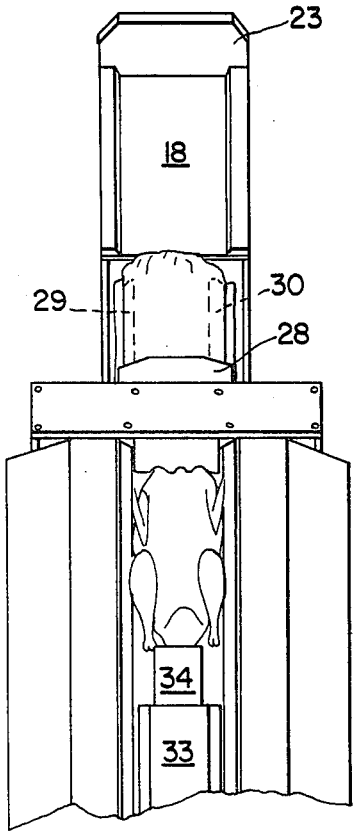
FIG. 2 is a top plan showing axially advancing by centrally pushing the tail of the carcass.
Figure 3:
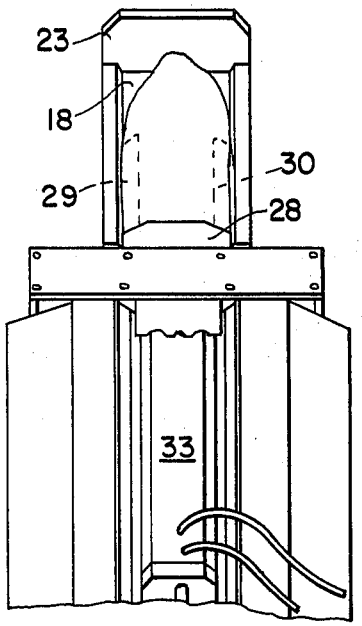
FIG. 3 shows engaging of the fowl legs and pushing the legs so as to stuff the fowl carcass into the package and against a restraining plate.
Figure 4:
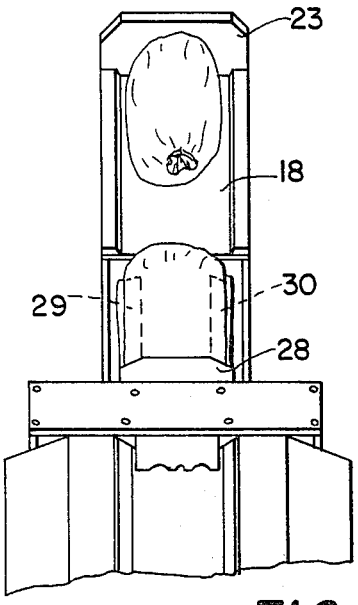
Figure 5:
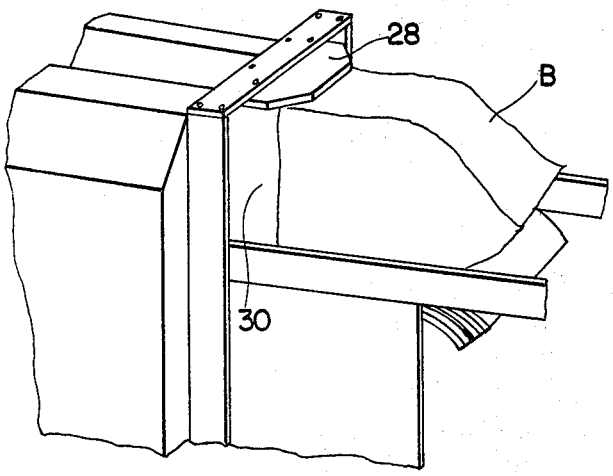
FIG. 5 is a side elevation, showing air pressurized opening of the top bag and advancing of the stretch horns into the bag.

The center pusher 34 is extended and retracted twice in each machine cycle, first extended as in FIG. 2 to push the bird into control then retracted, and secondly extended to hold the bird in the under hocking plate 28 "hocked" position as in FIG. 1-D while bag opening horns 29 and 30 are being extracted from the bag.

Figure 9:
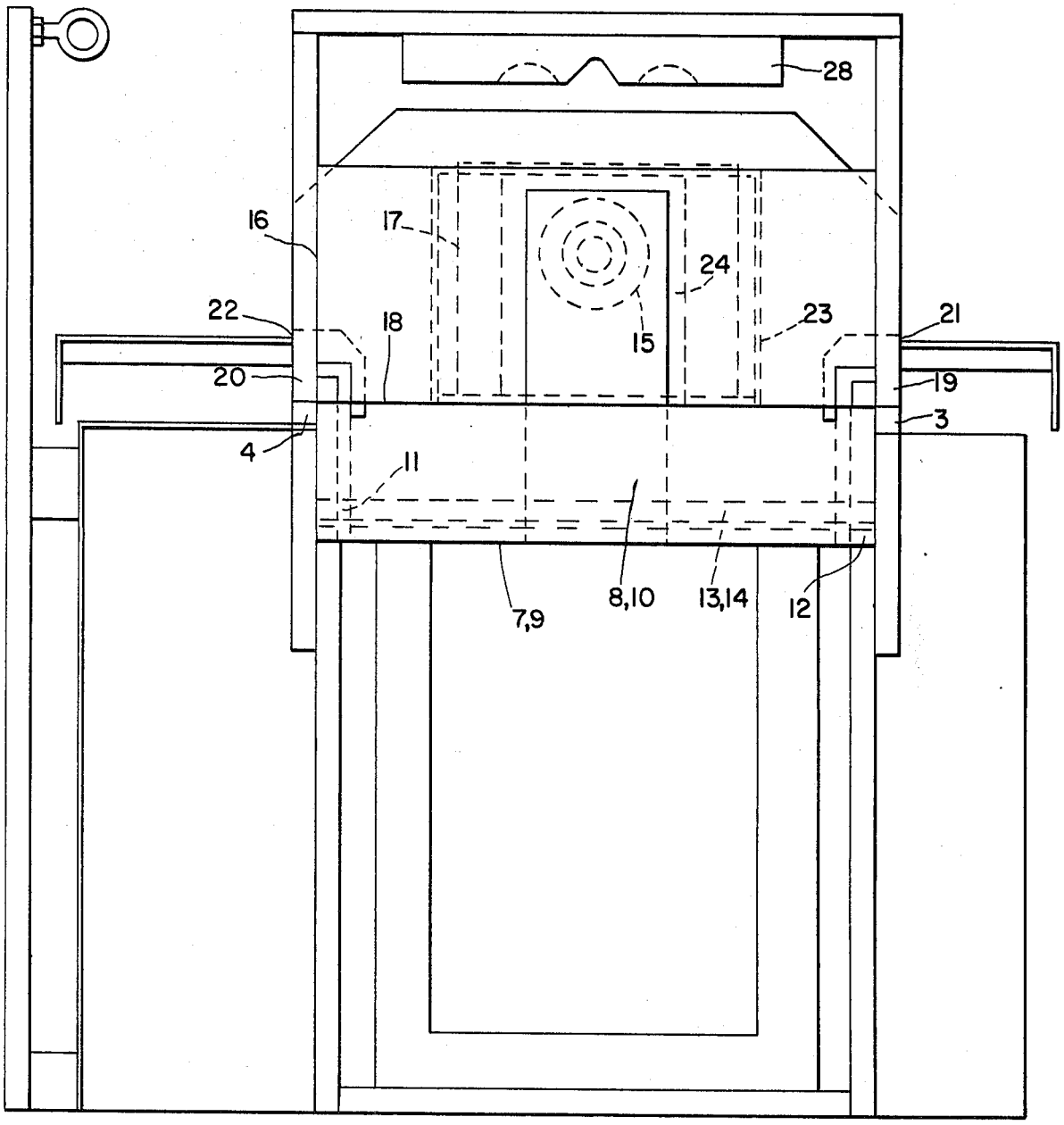
FIG. 9 is a transverse elevation of the hocking tray and hocking plate.
Figure 10:
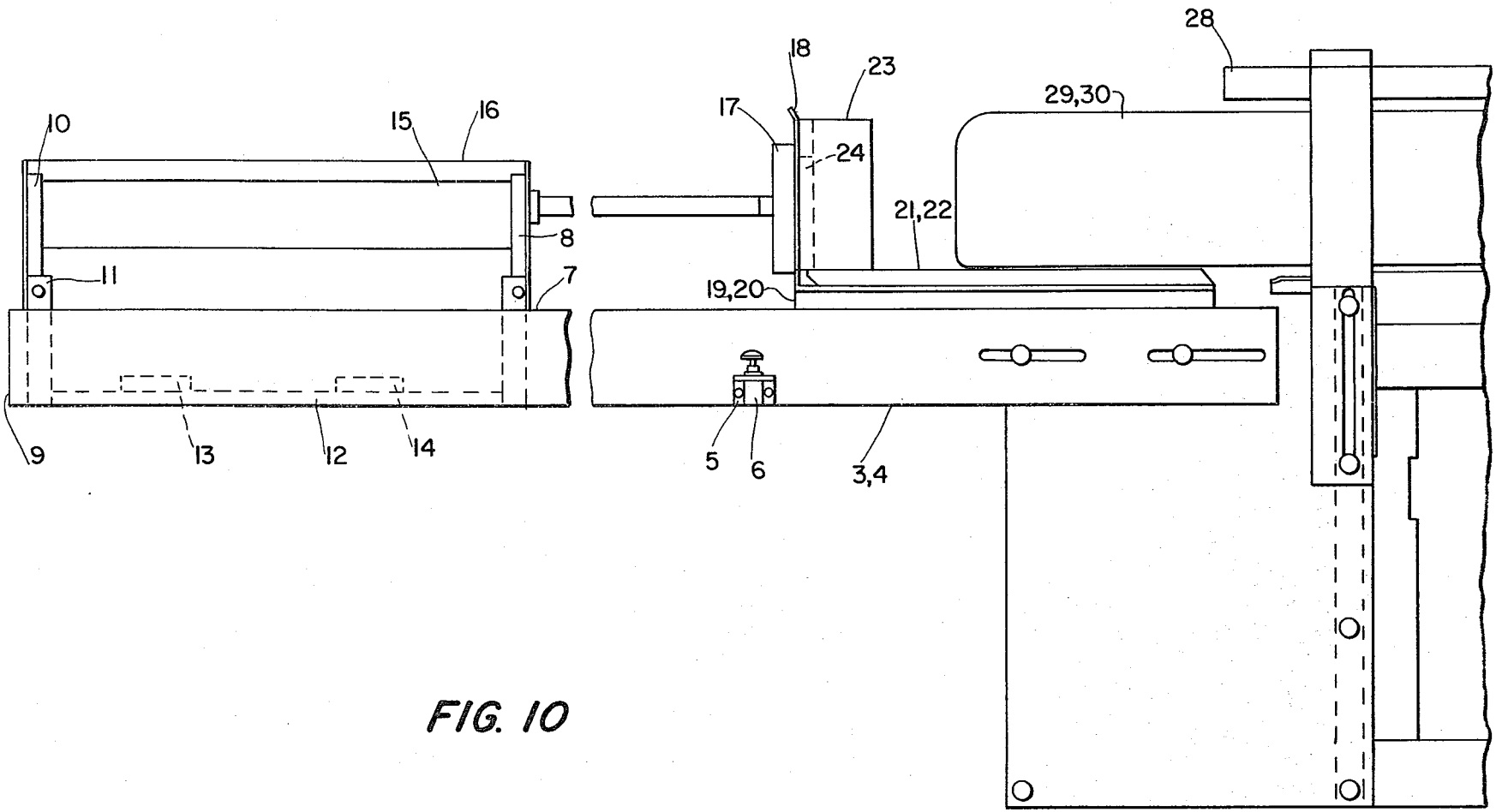
FIG. 10 is a fragmentary side elevation of the hocking tray and leg control plate assembly.

As illustrated in FIGS. 9 and 10 the hocking tray assembly consists of operator side side rail 3, bagging side side rail 4, palm button valve mounting bracket 5, palm button valve 6, tray cylinder front cross member 7, tray cylinder front upright 8 and rear cross member 9, rear upright 10, corner gusset 11, bottom valve mounting support bar 12, rear valve mounting bar 13, front valve mounting bar 14, tray push cylinder 15, tray push cylinder cover 16, push cylinder rod end block 17, hocking tray table 18, operator's side tray table slide 19, bagging side tray table slide 20, operator's side tray table side rail 21, bagging side tray table side rail 22, hocking control cavity block 23 and removable, disposable hocking pad 24.

The purpose of the hocking tray assembly is to provide a means of supporting the bagged bird, as it is being pushed through the stretch horns 29 and 30 and a means of reciprocally mounting the hocking control cavity block 23 and hocking pad 24.

When the table with stretch horns 29 and 30 comes to the full forward position, it activates a limit valve which causes stretch horns 29 and 30 to open laterally, shuts off the bag opening air system and lowers the bag elevator down on to the elevator drop control cylinder rods so that the hocking tray table 18 can come in over the superposed plastic bags on the bag elevator.

The hocking tray table 18 is moved into position by the tray push cylinder 15 when the operator activates the two palm button valves 60 to start the machine cycle. When table 18 moves to its proper position, it activates a limit valve to signal main pusher cylinder 51 to extend, to push or stuff the bird into the bag. At the proper point in the forward stroke of the main pusher cylinder 51, guide rod 48 activates a limit valve which signals a power valve to block the air to the tray cylinder 15, which moved it into position over the bag elevator and to exhaust the air between that power valve and the tray cylinder 15 through a needle valve, so that the "pumping action" of the tray cylinder 15 piston and the needle valve can be regulated to give enough resistance between the hocking tray 18 and pad 24 and the main pusher 33 to properly hock the birds being bagged, as main pusher 51 continues to its fully extended position. This switching system is designated "tray relax".

A similar system is used to "relax" stretch horns 29 and 30 so that as the horns are being withdrawn from the loaded bag, there is no outward force on the stretch horns which would split the mouth of the stretch bag.

As in the parent application, there is a circuit to make the table 18 return to the full back or rear position and try to blow open and enter the top bag on the bag elevator in the event that stretch horns 29 and 30 did not properly enter on the first try.

Applicant has added an "elevator drop control system", consisting of two "drop control cylinders" whose action is to extend a limiting rod under the legs of the bag elevator slide assembly to allow, but limit, the amount the elevator and array of superposed bags can be lowered during automatic cycling. These limiting rods are extended automatically when the machine's "run/stop" selector valve is placed in the "run" position. They automatically retract when the "run/stop" selector valve is place in the "stop" position.

To attain rapid cycling of the machine, quick exhaust valves are installed at or near the cylinder ports on both ends of main pusher cylinder 51, center pusher cylinder 35 and on the rod end of hocking tray push cylinder 15.

These machines may be equipped with frame side covers, not shown, which act as a guard as well as a cover. They are held in place by quarter-turn fasteners for quick and easy access and reassembly for cleaning and maintenance.

An emergency stop system has been added which consists of a detented mushroom head power "ON/-OFF" valve mounted so that the operator can actuate it with the hand or any part of the body by pushing it inward. This action causes the "main air supply power valve" to shift and dump all air in the machine to the atmosphere, stopping machine movement instantly. The detented "ON/OFF" valve is pulled outward to put power on the machine.

Figure 13:
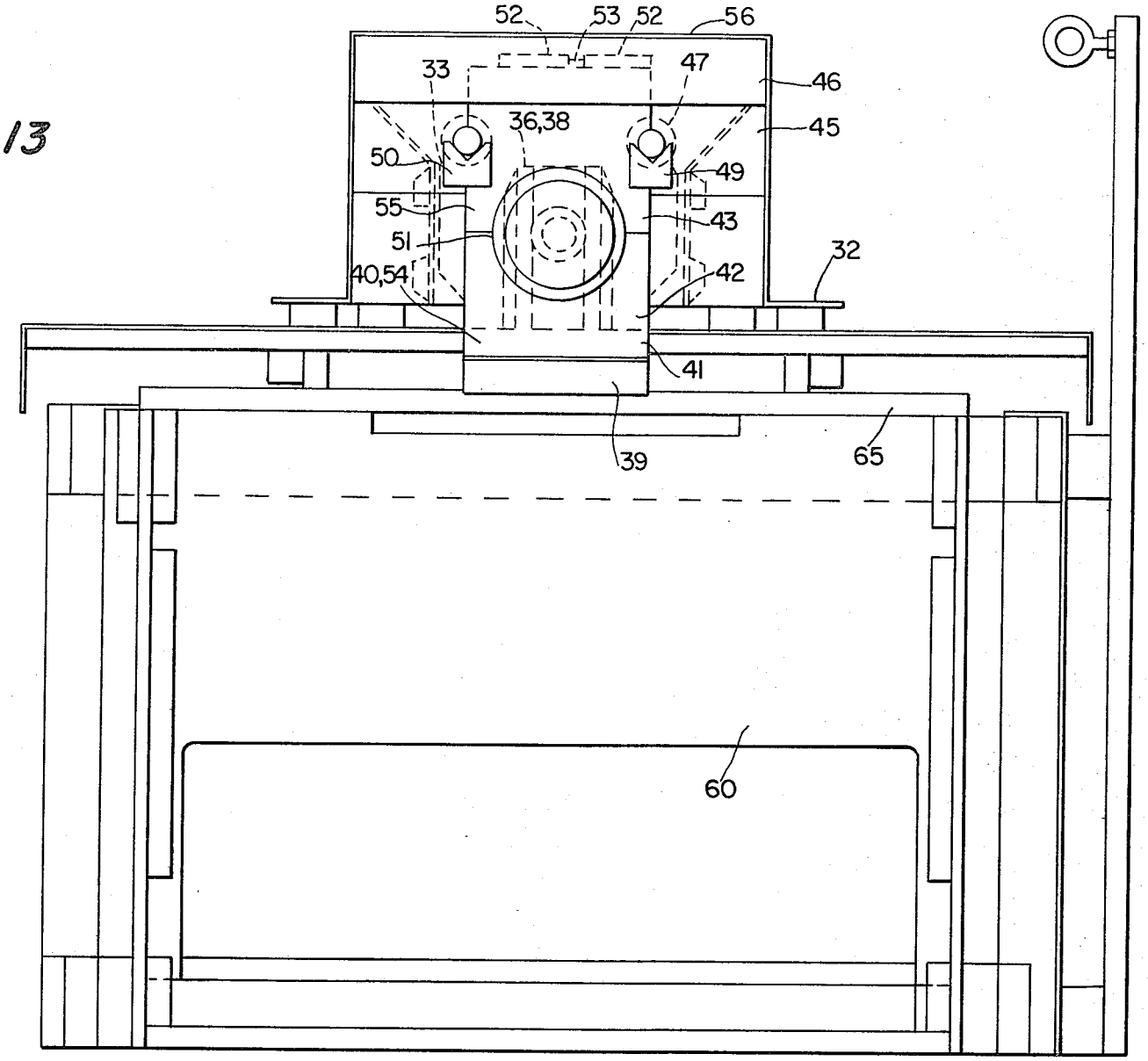
FIG. 13 is an end elevation from the control cabinet looking forward to the keel plate alignment guide.

A step-by-step description of the control logic system illustrated in FIGS. 13 and 14 and the power system, detailing each step of both the "stop" cycle and the "run" cycle, is set forth below.

OPERATION

To understand how and why the control and power air circuits works, it is first necessary to learn the name and function of the individual components in these systems. They are listed as follows:

The "run/stop" 4-way toggle valve, "SV-1". This valve allows the operator to select (2) distinct operating modes. In the "stop" mode the table or carriage will move to its "full back" position regardless of its position when "SV-1" was changed from the "run" mode to the "stop" mode. The "main pusher cylinder", the "tray cylinder", and the "elevator drop control cylinder", will also retract their piston rods to their "full back" position.

The power valve (PV-3) will shift its spool to the "B" position stopping air flow to the "bag opening air jets" and the "bag elevator lift cylinder" will extend as far as the supply of bags on the elevator will permit. The machine should always be placed in the "stop" mode before turning on the "main air supply" to the machine and must be in the "stop" mode to load or unload the bags on the "bag elevator".

In the "run" mode the machine will automatically blow open the top bag on the bag elevator, move the table and horns forward into the blown open bag, extend the horns outward to stretch open the bag, shut off the "bag opening air jets", lower the bag elevator slide assembly down until the legs of the slide assembly rest on the now extended "drop control cylinder rods". The "center pusher" 34 will extend forward out of the "main pusher body" 33. The machine is now ready for the operator to load and start the machine for one automatic cycle.

In the logic circuit there are (6) air manifolds, "M1", "M2", "M3", "M4", "M5" and "M6". These are used where several components are connected to a common supply point.

The logic circuit uses the following 3-way limit valves "LV-1", "LV-2", LV-3", "LV-6", "LV-7", "LV-8", and "LV-9". LV-1, 2, 3, 7, 8 and 9 are normally closed (NC) limit valves which means that they will pass air from the In port thru and out the Out port, only when the stem on the limit valve is depressed or moved inward, the proper amount to open the In and Out ports to each other. When the stem is released, an internal spring will force the stem outward, closing the air flow path between the In port and the Out port and opening a flow path from the Out port through the valve and out through a hole in the valve stem, releasing any air pressure downstream of that particular limit valve (LV) so that there will be no bucking pressure on any component to which that particular limit valve (LV) was connected.

Limits valves "LV-4" and "LV-6" are normally open (NO) limit valves and work exactly opposite to the (NC) limit valves; that is, the valve stem must be depressed to block the flow path or stop the air flow and exhaust any downstream pressure thru the hole drilled in the valve body for this purpose. In both the (NO) and (NC) limit valves the flow path to exhaust is automatically closed when a flow path from the In port to the Out port is made.

The reason for a control circuit is to allow the machine to have a means of shifting the valve spool (spool) in any of the power valves (PV) from one position to the opposite position so that a flow path can be changed to move an air cylinder's piston and rod to its extended (out) or retracted (in) position, in the proper or designed part of any cycle of the machine.

Power valves (PV), relay valves (RV) and time delay relay valves (TD) have either one or two pilot ports which are part of a sealed air chamber with a piston contained in this chamber which when air pressure is applied to either pilot port, not both simultaneously, will force the spool to move away from the pilot point being pressurized until it moves as far as it can in that direction within the valve body. When the spool shifts, it reverses the paths in that valve. If the spool had already been shifted and air pressure was re-applied to the pilot point which had caused the spool to shift to its present position, no action would take place.

The pilot points are referred to as "A" or "B", and if pressure is applied at pilot point "A", the spool will move to the "A" position. If pressure is applied to the "B" pilot point, the spool will move to the "B" position.

Some power, relay and time delay relay valves are of the spring-offset or spring-return type in which a spring is holding the spool all the way in one direction, and only when air is applied to the opposite pilot point will the spool move against the spring. As soon as that air pressure is released, the compressed spring will return the spool to its original or offset position. On all spring-offset valves the spring is considered to be the "B" pilot point and the spool will remain in or return to the "B" position until air pressure is applied and maintained at the "A" pilot point.

In the design of this control circuit it is necessary to direct air to some of the pilot points and/or flow path ports from more than one source. In order to do this, applicant uses a component known as a shuttle valve. This is a valve in which air can be applied on either of two "in" ports and will flow out one common "out" port but will never make a flow path between the two "in" ports. The shuttle valve modules used in this machine are dual shuttle valves in one body with ports 1 and/or 3 flowing thru and out port 2 as one unit (S-#-A) and ports #5 and/or 7 flowing through and out port #6 as the second unit (S-#-B) in the dual shuttle valve. Applicant uses "S-1-A" and "S-1-B", "S-2-A" and "S-2-B", "S-3-A" and "S-3-B", "S-4-A" and "S-4-B", "S-5-A" and "S-5-B".

In summary, all of the valves used in this control circuit are there to create flow paths for air under pressure to reach the proper pilot point in each valve in the cycle, to be able to move the proper spool into the correct position to do the function required and to create flow paths which will exhaust the opposite pilot points. The exhausting of the air pressure on any pilot point on any two position double piloted valve will not cause the spool to shift.

Figure 14:
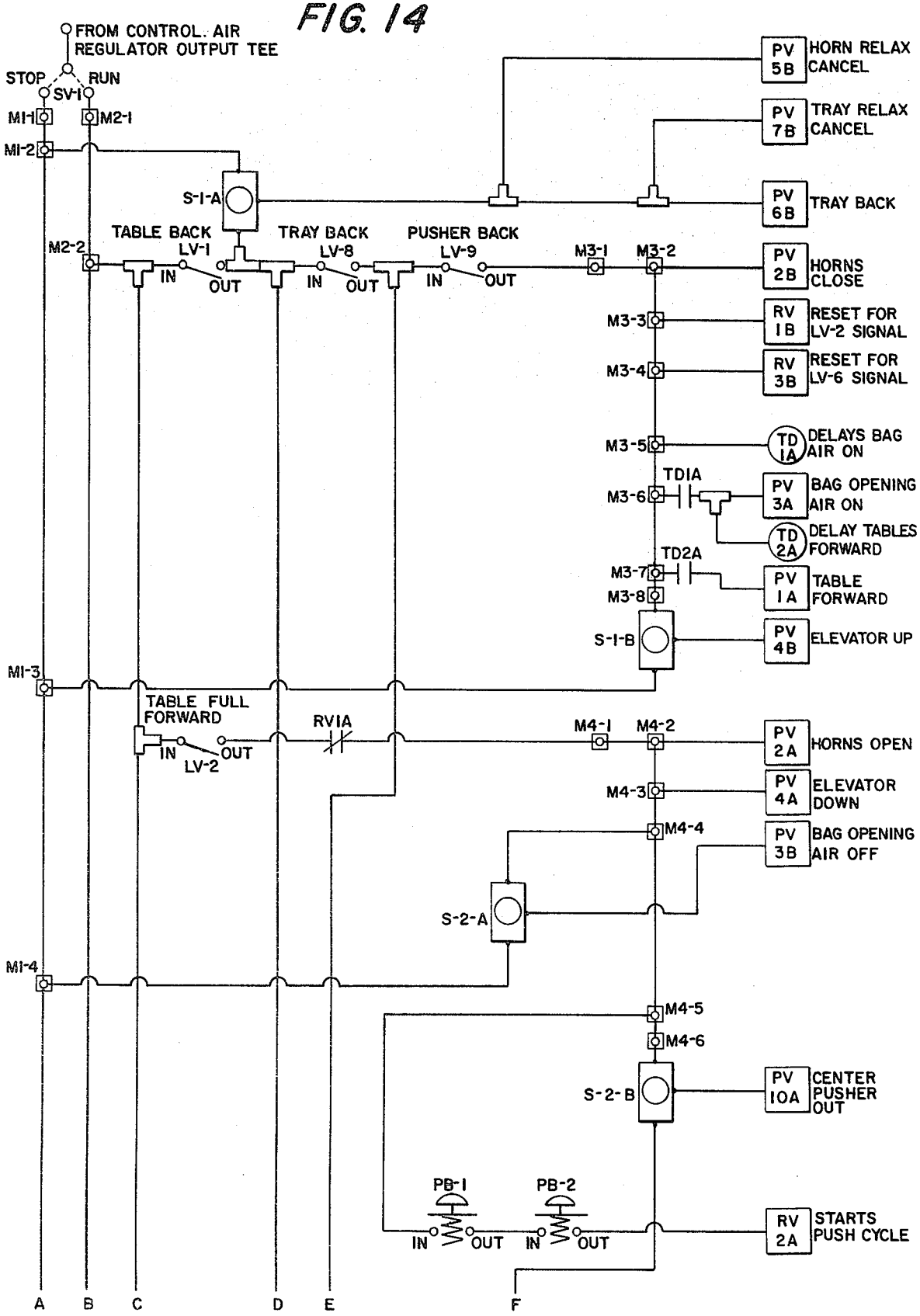
FIG. 14 is a first half control air logic diagram.
Figure 15:
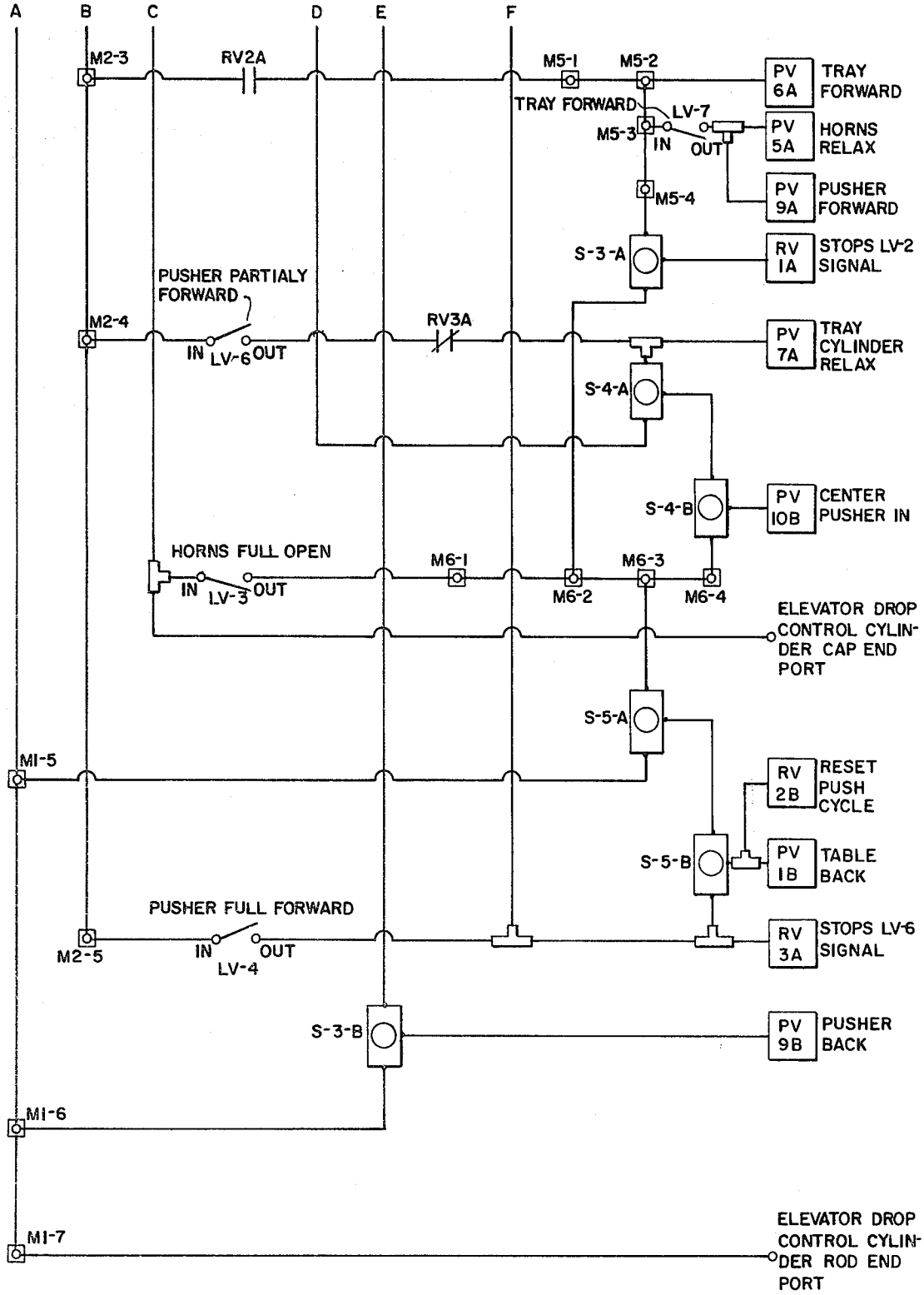
FIG. 15 is a second half control air logic diagram.

We are now ready to examine and explain the control logic circuit illustrated in FIGS. 14 and 15. The diagram is known as a ladder diagram, so called because each step in the circuit is on one of the numbered rungs of the ladder diagram (1-87).

The symbols used in this diagram are as follows:

1. A square with a dot in the center with a line running thru two or more sides of the square and connected to the dot is a manifold port. (Example, M1-1 is port #1 of manifold 1.)

2. A line branching off from another line with a tee drawn around these lines is just that, a tee. The ports of the tees are numbered 1 (either end), 2 (center) and 3 (opposite end). The limit valves (LV-#) are marked "In" and "Out". The shuttle valves are marked (S-#-A), 1 & 3 are in ports, #2 is the output port and (S-#-B) 5 and 7 are the in ports, #6 is the output port.

The flow path ports of relay valves (RV-#) or time delay valves (TD-#) are numbered 1, 2, or 3. The flow is always read from left to right. A flow path in a Not Passing condition is shown as a line running from left to right with a vertical bar on its right hand end, with a gap between a parallel vertical bar and the continuation of the left to right line to its next connecting point or port.

At the juncture of the left side line and vertical bar will be the port number of the valve to which the line is to be connected. This is the input side of the circuit. The other side line and vertical bar will be numbered with the number of the output port of that valve. The exhausting of the downstream air pressure thru the output port to atmosphere is not shown but understood when this symbol is used.

A passing condition is shown in a similar manner except for the addition of a diagonal line touching both vertical bars, they too have the input port number on the left side of the symbol and the output port on the right side. The output to exhaust flow path is not shown but understood to be blocked or not passing.

All limit valves are shown in this diagram in the Not Passing condition.

On the right side of the diagram are the various pilot points which are pressurized in sequence as the machine proceeds thru an automatic cyclic. The square block with the markings "PV-#-A or B", "RV-#-A or B" are either the "A" pilot point or the "B" pilot point of the power valve (PV) or relay valve (RV) corresponding to the number assigned to that valve. The round symbol indicates a spring-off valve, in this case the two time delay relay valves.

The following is a list of the valves and their identification and what they control.

POWER VALVES (A)—PV-1 controls the table or carriage cylinder.
(B)—PV-2 controls the horns stretch cylinder.
(C)—PV-3 controls the bag opening jet air on/off.
(D)—PV-4 controls the bag elevator lift cylinder.
(E)—PV-5 controls the horns relax feature of this circuit.
(F)—PV-6 controls the tray assembly cylinder.
(G)—PV-7 controls the tray relax feature of this circuit.
(H)—PV-8 is not used in this machine.
(I)—PV-9 controls the main pusher cylinder.
(J)—PV-10 controls the center pusher cylinder.

There are (3) relay valves (RV-1), (RV-2), and (RV-3) in this circuit and (2) time delay relay valves (TD-1) and (TD-2) in this circuit.

LIMIT VALVES (A)—LV-1 is depressed (made passing) when the table or carriage is in the full back position.
(B)—LV-2 is depressed (made passing) when the table or carriage is in the full forward position.
(C)—LV-3 is depressed (made passing) when the horn stretch slide assembly is forced outward to its full open position. This limit valve is used only if the horns fail to properly enter a blown open bag.
(D)—LV-4 is activated (released) (made passing) when the main pusher cylinder reaches its full forward position.
(E)—LV-5 is not used in this circuit.
(F)—LV-6 is activated (released) (made passing) when the guide rod on the main pusher assembly runs out past LV-6 on its way to the full forward position.
(G)—LV-7 is activated (depressed) (made passing) when the tray assembly is in its full forward position.
(H)—LV-8 is activated (depressed) (made passing) when the tray assembly is in its full back position.
(I)—LV-9 is activated (depressed) (made passing) when the guide rod on the main pusher assembly is in its full back position.

Starting at rung #1 on this diagram, you will see that port #1 of (SV-1) is connected to the output side of the control air regulator. This regulator should be set and locked on 80 lb. pressure. It should never be changed from this setting.

First, we will follow the air flow which occurs when (SV-1) is placed in the "Stop" mode. A flow path from port #1 thru port #4 of (SV-1) pressurizes all ports of manifold #1 and releases any pressure which might have been in manifold #2 out through Port #2 and through port #3 of (SV-1). Looking at rung 4, you will notice that M1-2 is connected to S-1-A #1 which continues on thru S-1-A out #2 and thru 2 tees to (PV-5B), (PV6-B), (PV-7-B). The wording to the right of the pilot point symbols tells what action will occur from the shift of the valves affected.

Going on down line "A" to M1-3, you will see that a flow path is created from M1-3 to S-1-B #7 out S-1-B #6 to (PV-4B) and the bag elevator will rise.

A flow path will be created from M1-4 to S-2-A #3 out S-2-A #2 to (PV-3-B) and the bag opening air jets will be turned off.

A flow path will be created from M1-5 to S-5-A #3 out S-5-A #2 on into S-5-B #5 out S-5-B #6 on through a tee to (RV-2-B) which resets this relay valve to its Not Passing condition and to (PV-1-B) which returns the table or carriage to its full back position.

A flow path is created from M1-6 to S-3-B #7 out S-3-B #6 to (PV-9-B) which will return the main pusher assembly to its full back position.

A flow path is created from M1-7 to the rod end of the two elevator drop control cylinders causing their piston and rods retract to retract out of the way of the legs of the bag elevator slide assembly.

The machine can now have its main air supply shut off. All the air in the machine's control and power circuits will be exhausted and the bag elevator will fall to its lowest position and lean forward for easy removal of an empty wicket or loading of a new wicket of bags.

As soon as a new wicket of bags has been loaded on the bag elevator assembly, the machine's main air supply can be turned on. This will automatically cause the bag elevator with its load of bags to rise until the wicket cross-bar is locked against the bottom of the initial bag opening jet blast assembly. When this condition is reached it is time to switch (SV-1) from the "Stop" mode to the "Run" mode.

When (SV-1) is changed from stop to run, a flow path will be created from port #4 thru port #5 of (SV-1) exhausting any air in line A and manifold #1 and any components connected to manifold #1.

At the same time a flow path will be created from port #1 thru port #2 of (SV-1) on to port #1 of manifold #2 pressurizing line B and all ports of manifold #2.

A flow path will be created from M2-2 through a tee to the In port of LV-1 and down line C to a tee which connects to the In port of LV-3 and to the cap end of the elevator drop control cylinders which causes their rods to extend under the legs of the bag elevator slide assembly, thus controlling the amount the bag elevator slide assembly can drop as long as (SV-1) remains in the "Run" mode.

A flow path is created from M2-3 to the In port of (#1) of RV-1. No action.

A flow path is created from M2-5 to the In port of LV-4. No action.

Since the table was in or whenever it returns to the full back position, a flow path is created thru LV-1 making it passing. Air now flows from port #2 of LV-1 thru the (2) tees to port #3 (S-1-A), the In port oV-8 and down line D to ports #3 of S-4-A out port #2 of S-4-A on to port #5 of S-4-B out port #6 of S-4-B on to PV-10-B which will cause the center pusher assembly to retract inside the main pusher. Air also flows from port #3 out port #2 of S-1-A on thru (2) tees to pilot points (PV-5-B), (PV-6-B), and (PV-7-B). These pilot points had just been pressurized when (SV-1) was in the "Stop" mode so no action will occur until the machine runs thru its first cycle in the "Run" mode at which time pressurizing PV-5-B will cause the horns relax circuit to return to its starting position. PV-6-B will cause the tray assembly to return to its full back position and PV-7-B will cause the tray relax circuit to return to its staring position.

When tray slide assembly 18 is in full back position, or whenever it returns to its full back position, a flow path is created thru LV-8 making it Passing. Air now flows through a tee to the In port LV-9 and down line E to port #5 and out through port #6 of S-3-B on to PV-9-B, causing the main pusher assembly to return to its full back position, if it is not already there.

When the main pusher assembly 51 was in full back position, or whenever it returns to its full back position, it activates LV-9 making it Passing from the In port through LV-9 to its Out port on to port #1 of manifold #3 which pressurizes all ports of manifold #3.

There is a flow path from M3-2 to PV-2-B causing stretch horns 29 and 30 to close toward each other.

There is a flow path from M3-4 to port #6 of RV-3 causing it to shift to Passing from port #3 to port #2 of RV-3.

There is a flow path from M3-5 to port #4 of TD-1 (TD-1-A) which starts TD-1 to Timing.

There is a flow path from M3-6 to port #1 of TD-1. Port #1 to port #2 of TD-1 is "Not Passing" until the air metering in thru port #4 of TD-1 to its pilot point "Times Out" and shifts TD-1 to a "Passing" condition, allowing air to now flow from port #1 through port #2 to PV-3-A causing the bag opening air to be turned on. The tee between port #2 of TD-1 and PV-3-A also allows air flow to port #4 of TD-2 (TD-2-A) which starts TD-2 to Timing.

There is a flow path from M3-7 to port #1 of TD-2, port #1 of TD-2 is "Not Passing" until air metering in thru port #4 of TD-2 to its pilot point times out and shifts TD-2 to a "Passing" condition, allowing air to flow from port #1 thru port #2 to PV-1-A causing the table or carriage to start toward its full forward position.

There is a flow path from M3-8 to port #5 and out port #6 of S-1-B on to PV-4-B causing the bag elevator to rise, if it is not already up.

TD-1 is in the circuit to allow enough time after LV-9 is made Passing for the horns to close and the elevator to be up before the bag air jet blast starts.

TD-2 is in the circuit to allow enough time for the top bag to be blown fully open before the table or carriage starts to move the closed horns into the blown open bag. TD-2 cannot start to time out, until TD-1 has timed out.

As soon as the table or carriage moves forward enough to release the stem of LV-1, all air downstream of the Out port of LV-1 is returned thru the Out port and exhausted through the stem exhaust port of LV-1. This depressurizes the following pilot points: PV-5-B, PV-6-B, PV-7-B, PV-2-B, RV-3-B, TD-1-A, TD-2-A, PV-3-B, PV-1-A, PV-4-B.

There will be no action in any of these power valves or relay valves. Because TD-1 and TD-2 are spring-off valves, they will return their port #1 to port #2 to the Not Passing condition.

When the table or carriage reaches its full forward position, the actuator mounted underneath the carriage on the operator's side which released LV-1 and allowed it to return to the Not Passing condition, now depresses and holds LV-2 in a Passing condition. There is now a flow path from the In port out through the Out port of LV-2 on thru port #3 of RV-1 which has been made Passing earlier in the cycle so that air now flows from port #3 through and out port #2 of RV-1 on through port #1 of manifold #4 which pressurizes all ports of manifold #4.

There is now air flowing from M4-2 to PV-2-A which causes PV-2 to shift and move the horns outward to the limit the applied pressure on the horns stretch cylinder will be overcome by the strength of the film of the bag.

Air flow from M4-3 to PV-4-A causes PV-4 to shift and bring the bag elevator slide assembly down until the legs rest on the extended rods of the elevator drop control cylinders.

Air flow from M4-4 to port #1 thru and out port #2 of S-2-A on to PV-3-B causes PV-3 to shift, shutting off the air flow to the bag opening jets.

Air flow from M4-5 to PB-1 In port makes the palm button valves PB-1 and PB-2 ready for operation when required.

Air flow from M4-6 to port #5 thru and out port #6 of S-2-B on to PV-10-A causes PV-10 to shift and extend the center pusher assembly out from inside the main pusher assembly.

The machine is now in the "Ready To Load" position. The operator now places the bird to be packaged on its back with its legs toward the face of the main pusher and its tail in front of the cavity in the face of the center pusher 34, between the side guides, with the breast in the funnel shaped portion of the stretch horns 29 and 30 and under the keel and leg control plate 28 with the keel in the center groove of this plate.

The bird is now properly loaded in the machine. The operator now moves the hands to the two separate palm button valves PB-1 and PB-2 and depresses both simultaneously and holds them depressed until the face of the main pusher has started under the keel and leg control plate. Caution must be used not to release the two palm buttons until this point or the operator could accidently get the hands caught between the main pusher and this plate causing serious injury to the operator.

Only when both PB-1 and PB-2 are activated or depressed together is a flow path made passing from the In port of PB-1 through and out the Out port of PB-1 into the In port and out the Out port of PB-2, on to port #4 of RV-2 (RV-2-A) causing RV-2 to shift, creating a flow path from M2-3 in port #1 and out port #2 of RV-2 on to port #1 of manifold #5 which pressures all ports of manifold #5.

Air flow from M5-2 to pilot point A of PV-6 (PV-6-A) causes PV-6 to shift causing the tray slide assembly to move forward toward the bag elevator. Since PV-6-B eas exhausted through LV-1 when it was released, there is no bucking pressure at PV-6-B and a smooth fast shift of PV-6 will take place.

Air flow from M5-3 to the In port of LV-7 will be blocked at the In port until LV-7 is activated by the activator cam mounted upon the underside of the tray slide assembly when it reaches the desired position on its forward stroke. LV-7 is maintained depressed even when the tray slide assembly reaches its full forward position.

When LV-7 was made Passing by the tray slide assembly, a flow path was created from the In port through the Out port of LV-7 on thru a tee to pilot points PV-5-A and PV-9-A.

Air pressure on PV-5-A causes the spool in PV-5 to shift to the A position which creates a flow path from the cap end of the horns stretch cylinder thru PV-5 and exhausts to atmosphere, thus releasing all pressure on the horn stretch cylinder and allowing the horns to relax. The shifting of the spool in PV-5 also blocked the flow path from PV-2 thru PV-5 to the cap end of the horns stretch cylinder.

Air pressure on PV-9-A causes the spool in PV-9 to shift to the A position, causing the main pusher cylinder to extend or move forward to push the bird into the bag.

Opposing or bucking pressure at PV-5-B and PV-9-B was exhausted as soon as LV-1 was released when the table or carriage moved forward from the full back position.

Air flows from M5-4 to port #1 out through port #2 of S-3-A on to port #4 of RV-1 (RV-1-A). This causes RV-1's spool to shift to the A position which makes the flow path from port #3 to port #2 of RV-1 "Not Passing", blocking the air pressure from the Out port of LV-2 from "Passing" through and downstream of port 3 to port 2 of RV-1. It also opens or makes "Passing" a flow path back thru RV-1 from port #2 to and out port #1 to atmosphere, exhausting all air pressure in manifold #4 and all pilot points connected to M-4 (PV-2-A), (PV-4-A), (PV-4-A), (PV-3-B), (PV-10-A), and the In port of (PB-1).

As the hocking tray slide assembly 18 moved forward, the cam on the underside of the tray slide assembly came off or released LV-8, allowing it to return to the "Not Passing" condition. Since LV-1 which is connected in series with LV-8 and LV-9 had already exhausted all air pressure in manifold #3 and all pilot points connected to M3, there would be no action except to prevent air flow thru LV-8 when LV-1 is made passing again.

As main pusher assembly 51 moves forward, the limit valve actuator and guide rod would release LV-9 allowing it to return to the Not Passing condition. Like LV-8, it would remain "Not Passing" even after LV-1 and LV-8 were made "Passing" until the guide rod once again made LV-9 "Passing" by return to the main pusher full back position.

At an adjustable position in the forward stroke of the main pusher assembly 51 the guide rod would release LV-6, allowing it to go to the "Passing" condition. Air would now flow from M2-4 thru the In port and out the Out port of LV-6 on to port #3 of RV-3, on out port #2 of RV-3 thru a tee to the A pilot point of PV-7, (PV-7-A) causing the spool in PV-7 to shift to the A position. The shifting of PV-7's spool would set up a blocked flow path from PV-6 thru PV-7 to the cap end of tray slide cylinder 15 back thru and out PV-7 to an adjustable needle valve which would control the speed of the exhausting air from the cap end of tray slide cylinder 15. This is designated "tray relax".

At the same time air pressure from the other port in the tee in this line would flow to port #1 thru and out port #2 of S-4-A, on to port #5 thru and out port #6 of S-4-B on the B pilot point on PV-10 (PV-10-B) to the B position which causes the center pusher cylinder 34 to retract, moving the center pusher 34 back inside the main pusher 51.

The main pusher assembly 51 continues forward, pushing the bird into the bag, against the hocking pad 24 and the tray slide cylinder piston 15 back toward its cap end. The backward movement of this piston causes a "Back Pressure" in the flow path from the tray slide cylinder cap end, thru the Passing flow path in PV-7 against the adjustable opening of the needle valve on to atmosphere. The needle valve is adjusted (screwed in for greater "Back Pressure"), (screwed out for less) until there is enough resistance of the tray slide assembly for the main pusher to hock the leg of the bird being packed. The needle valve may have to be adjusted from time to time depending on the average size and condition of the birds being packed.

When the main pusher assembly 51 reaches the full forward position, the guide rod will release LV-4, allowing it to go to the Passing condition. Air will now flow from M2-5 in and out through LV-4 through (2) tees to port #7 of S-2-B and port #7 of S-5-B and port #4 of RV-3 (RV-3-1).

Pressure on RV-3-A will cause the spool in RV-3 to shift to the A position which creates a Not Passing condition from port #3 to port #2 of RV-3, blocking the flow from LV-6 at port #3. It will also create a flow path from port #2 out thru port #1 of RV-3 exhausting to atmosphere all pressure against pilot points PV-7-A and PV-10-B, preventing any bucking pressure against these pilot points.

Air will also flow in port #7 and out port #6 of S-2-B on to port #14 of PV-10 (PV-10-A) causing the spool in PV-10 to shift to the A position, causing center pusher assembly 34 to move forward out from the body of the main pusher 51, holding the hocked bird in position while stretch horns 29 and 30 are being withdrawn from the loaded bag. It also holds the bird in the hocked position until tray slide assembly 15 has reached its full back position and main pusher 51 has started back toward its full back position.

This allows the operator a chance to transfer control of the packaged, hocked bird from the machine to the operator who will now close the package with a bag tying unit of the customer's choice mounted within easy reach of the tray slide assembly and the operator.

When the LV-4 became Passing, air flowed to port #7 through and out port #6 of S-5-B on to port #12 of PV-1 (PV-1-B) and port #6 of RV-2 (Rv-2-B). Pressure on PV-1-B shifted the spool in PV-1 to the B position, causing the table or carriage 18 to move toward its full back position. This movement of the table or carriage rearward released LV-2, allowing it to return to the Not Passing condition from the In port to the Out port of LV-2 and releasing the pressure in the line between port #3 of RV-1 and the Out port of LV-2 out thru the exhaust hole in the stem of LV-2. Pressure on RV-2-B shifted the spool in RV-2 to its B position, returning port #1 to port #2 of RV-2 to a Not Passing condition, blocking the air flow from M2-3 at port #1 of RV-2 and exhausting all pressure in manifold #5 and the pilot points ports and limit valve ports connected to M-5, port #14 of PV-6 (PV-6-A), port #12 of PV-5 (PV-5-A), port #14 of PV-9 (PV-9-A), port #4 of RV-1 (RV-1-A) and the in port of LV-7, out thru port #2 of port #3 of RV-2 to atmosphere.

When the table or carriage 18 reaches its full back position, the limit valve actuator bar under the carriage assembly which released LV-2 will now depress LV-1 moving its stem or spool to the Passing condition.

Air now flowing thru LV-1 from M2-2 pressurizes the following pilot point ports:

(A)—PV-5-B, shifting the spool in PV-5 to the B position, which re-establishes the flow path from PV-2 thru PV-5 to the cap end of the horns stretch cylinder, which moves the horns 29 and 30 of their most outward position. This prevents the main pusher assembly 51 from catching on the end of the horns as the main pusher 51 returns between the fully opened horns 29 and 30 on its way back to its full back position. Since the table or carriage is in the full back position instead of the full forward position, action of the horns moving to their full open position will not activate or depress LV-3.

(B)—PV-7-B, shifting the spool in PV-7 to the B position, which re-establishes a flow path from PV-6 thru PV-7 on to the cap end of the tray slide cylinder.

(C)—PV-6-B, shifting the spool in PV-6 to the B position, which creates a flow path from PV-6 to the rod end of the tray slide assembly, returning it to its full back position. Since both PV-6-B and PV-7-B were pressurized together, their spools will shift together and the new flow path from the cap end of the tray slide assembly thru PV-7 in and out of PV-6 to atmosphere will not have to go thru the needle valve used to provide hocking pressure and PV-6 and PV-7 will now be in the proper position for the start of a new loading cycle.

(D)—PV-10-B, shifting the spool of PV-10 to the B position for the second time in the loading cycle, causing the center pusher to again retract into the body of the main pusher assembly 51, so that it will not interfere with the inward closing of the stretch horns 29 and 30 when that occurs in the machine cycle.

When the tray slide assembly 18 reached its full back position, the activator cam on its underside released LV-7 allowing it to return to the Not Passing condition and activated or depressed the stem or spool on LV-8 creating a Passing condition in LV-8. Since LV-1 is now Passing and LV-8 is in series with LV-1 and is now Passing, air will now flow to the In port of LV-9 where it is blocked until LV-9 is made Passing by the return of the main pusher assembly to its full back position. Air will also flow to PV-9-B shifting the spool to its B position, causing the main pusher assembly 51 to start to return to its full back position.

On the way back from the full forward position the main pusher assembly 51, the limit valve actuator guide bar will first depress LV-4 moving it to a Not Passing condition which will exhaust all pressure in pilot point ports, #12 of PV-1 (PV-1-B), #6 of RV-2 (RV-2-B) and #4 of RV-3 (RV-3-A) preventing any bucking pressure on these pilot points when their opposite pilot points are pressurized in the cycle.

Continued backward travel of the guide rod will depress LV-6 moving it to the Not Passing condition and exhausting the air in the line between port #3 of RV-3 and the Out port of LV-6, thru the Out port on out the exhaust hole drilled in the body of LV-6. This will prevent a "ghost signal" created by air pressure trapped between the Out port of LV-6 and port #3 of RV-3 to try to shift the spools of PV-7 and PV-10 out of sequence if that air had not been exhausted when RV-3 was made passing again from port #3 to port #2.

When the main pusher assembly 51 guide rod reaches its full back position, it will depress the stem or spool in LV-9 making it passing, and the combination of LV-1, LV-8 and LV-9 all passing and in series starts a new machine cycle.

The machine will automatically go thru its proper sequences as explained in the first of this description until the machine stops in the ready to load position.

I claim:

1. A method of packaging fowl within stretch bags comprising:

A. Inverting a fowl carcass such that the breast is topmost and the legs protrude rearwardly above the tail;

B. Axially advancing by centrally pushing the tail of said carcass in a longitudinal direction;

C. Stretching open an open-ended bag within the path of pushing of the carcass;

D. Engaging and pushing both legs of the carcass, so as to longitudinally advance said carcass into the open-ended bag;

E. Interposing a restraining force in the path of longitudinal advance and at the forward end of said carcass, such that the leg joints of the carcass are broken and the legs are made to conform to the body of the carcass; and F. Again centrally pushing said carcass, so as to retain said carcass within said bag, while withdrawing pushing of both legs and stretching of said bag.

* * * * *